United States Patent [19]

Gleyze et al.

[11] 4,051,650

[45] Oct. 4, 1977

[54] YARN TEXTURIZING MACHINE

[75] Inventors: Jean Gleyze; Jean-Claude Dupeuble; Roger Forin, Roanne, all of France

[73] Assignee: ASA S.A., Roanne, France

[21] Appl. No.: 694,112

[22] Filed: June 8, 1976

[30] Foreign Application Priority Data

| | | |
|---|---|---|
| June 17, 1975 | France | 75.19497 |
| Apr. 6, 1976 | France | 76.10199 |

[51] Int. Cl.[2] ..... D02G 1/02

[52] U.S. Cl. ..... 57/34 HS; 57/106

[58] Field of Search ..... 57/34 R, 34 HS, 1 R, 57/157 TS, 106

[56] References Cited

U.S. PATENT DOCUMENTS

| | | | |
|---|---|---|---|
| 3,165,881 | 1/1965 | Moncuit et al. | 57/34 HS |
| 3,293,838 | 12/1966 | Batsch | 57/34 HS |
| 3,486,320 | 12/1969 | Mattingly et al. | 57/34 HS X |
| 3,631,664 | 1/1972 | Mackintush | 57/34 HS |
| 3,791,121 | 2/1974 | Ernst | 57/34 HS |
| 3,962,829 | 6/1976 | Schippers | 57/34 HS |

*Primary Examiner*—John Petrakes

*Attorney, Agent, or Firm*—Arnold, White & Durkee

[57] ABSTRACT

A yarn texturizing machine in which there are provided a plurality of treatment positions, each position having therein a substantially T-shaped framework having a vertical portion and a horizontal portion. Each framework has associated therewith, two false twisting arrangements, each including, in operational sequence, a yarn supply device, a first yarn feeder, a yarn heating device, a cooling zone for the heated yarn, a false twist spindle, a second yarn feeder and a wind-up device. The two false-twist spindles, the two second feeders and the two wind-up devices are each mounted on the vertical portion of the T-shaped framework and the remaining components, that is to say the first feeder, the heating device and the cooling device for each spindle are mounted on one of the horizontal portions. The yarn supply device for each spindle is mounted at a location below the free ends of the arm of the horizontal portion and defines, on each side of the frame with the vertical portion, a free passage zone along which the operator can pass and have easy access to the essential parts of the machine.

8 Claims, 6 Drawing Figures

YARN TEXTURIZING MACHINE

The present invention relates to an improved machine for the manufacture of texturised yarns by false-twist.

The so-called false-twist process of texturising thermoplastic yarns of continuous filaments has been known for a long time; it consists essentially of continuously over-twisting these yarns, subjecting them to a treatment in which this twist is set, and finally untwisting them, and if appropriate, subsequently subjecting them to a new heat resetting treatment in the partially relaxed state. As this process is widely used, it is unnecessary to describe it in detail, because yarn-twisting specialists have practised it successfully for many years.

French Pat. No. 1,263,807 of Chavanoz S.A. has described a machine for the manufacture of texturised yarns of this type, which consists of two separate bodies joined to one another by a platform on which the operator can move about and under which the yarn passes, with the first body comprising supply devices and collecting devices for the yarn and the second body comprising the texturising devices, that is to say especially the yarn feeders, the means of fixing the false-twist (heating zone and cooling zone) and the false twist spindle.

In practice, the machine constructed in accordance with these teachings comprise two texturising bodies joined back to back and thus forming only one body, on either side of which are located two supply and collecting bodies. This so-called "three-body" device has been very successful for many years and is used extensively, especially by the Applicant Company. In fact, it permits easy access by the operator to the essential parts of the machine, both as regards the supply and collection of the yarn and the passage of the yarn through the machine, and as regards access to the parts, for maintenance operations.

However, with the recent appearance, in the false twist texturising field, of undrawn or semi-drawn (partially drawn) yarns, this arrangement has not proved entirely satisfactory because firstly the bobbins coming from the extrusion spinning stage are larger and cannot be seated satisfactorily in the supply device, especially if it is desired to use them while keeping a reserve bobbin, and secondly, as a result of the increase in speeds, it has proved necessary to increase the length of the ovens, which makes it necessary to increase the height of the machines and makes them more and more difficult to service.

In the applicant company's French patent published under No. 2,219,257, an improvement to this device has also been described, according to which the machine also comprises an upper platform linking the two bodies, on which is placed the yarn supply device and under which the yarn to be texturised passes, the distance between the upper platform and the lower platform under which the texturised yarn passes being sufficient to allow the operator to pass, and to give him convenient access to the majority of the essential parts for starting up the machine.

Nevertheless, this device, which currently is proving very successful for texturising stretched yarns, partially drawn yarns and undrawn yarns, suffers from the disadvantage of being too tall.

The French patent published under No. 2,142,992 has described a texturising machine suitable for a combined drawing and texturising treatment, in which the essential parts are located along a bar which is arranged in a vertical plane. This makes it possible to reduce the bulk of the machine, but is costly to construct.

French Pat. No. 2,000,856 has described a machine in which the heating device is located at an angle at the top of the first body and in which the cooling path is located between the two bodies. This device has proved to be rather ill-suited to the simultaneous drawing and texturising technique, because the yarn undergoes a substantial change in direction between leaving the heating device and entering the spindle, which considerably increases the tensions of the yarn in the spindle. In British Pat. No. 1,199,071, where the heating device is located horizontally between the two bodies, the situation is the same as in the abovementioned French Patent because the yarn always undergoes a change in direction which resists the free upstream movement of the twist.

According to the present invention there is provided a yarn texturising machine comprising a plurality of treatment positions, each said position comprising a substantially T-shaped framework, having a vertical portion and a horizontal portion; and, in operational sequence, a yarn supply device, a first yarn feeder, a yarn heating device, a cooling zone for the heated yarn, a false twist spindle, a second yarn feeder and a wind-up device, the false twist spindle, the second feeder and the wind-up device being mounted on the vertical portion of the T-shaped framework and the first feeder, the heating device and the cooling zone being on the horizontal portion, the yarn supply device being mounted at a location below the free end of the horizontal portion, effective to define with the vertical portion, a zone through which the operator can pass and have easy access to the essential parts of the machine.

Such a machine is specially suitable for the treatment of standard yarns, partially drawn yarns or undrawn yarns at very high speeds and is convenient to use and easy to service and is also very versatile.

Advantageously, the cooling zone is located just above the zone through which the operator can pass and is aligned with the path of the yarn on leaving the heating device, the said heating device being located substantially horizontal. A resetting device and the third feeder may be provided and located just up-stream from the wind-up device and mounted on the vertical portion of the T-shaped framework and the supply device (creel) are located on the horizontal branch of the T-shaped framework and are optionally detachable so that they can easily be recharged or moved.

Thus, all the moving parts (feeders, spindle and collector) are grouped on a single central body, which avoids the transmission of movement and results in appreciable saving.

In order that the invention will be more fully understood, the following description is given, merely by way of example, reference being made to the accompanying drawings, in which.

Figure 1:
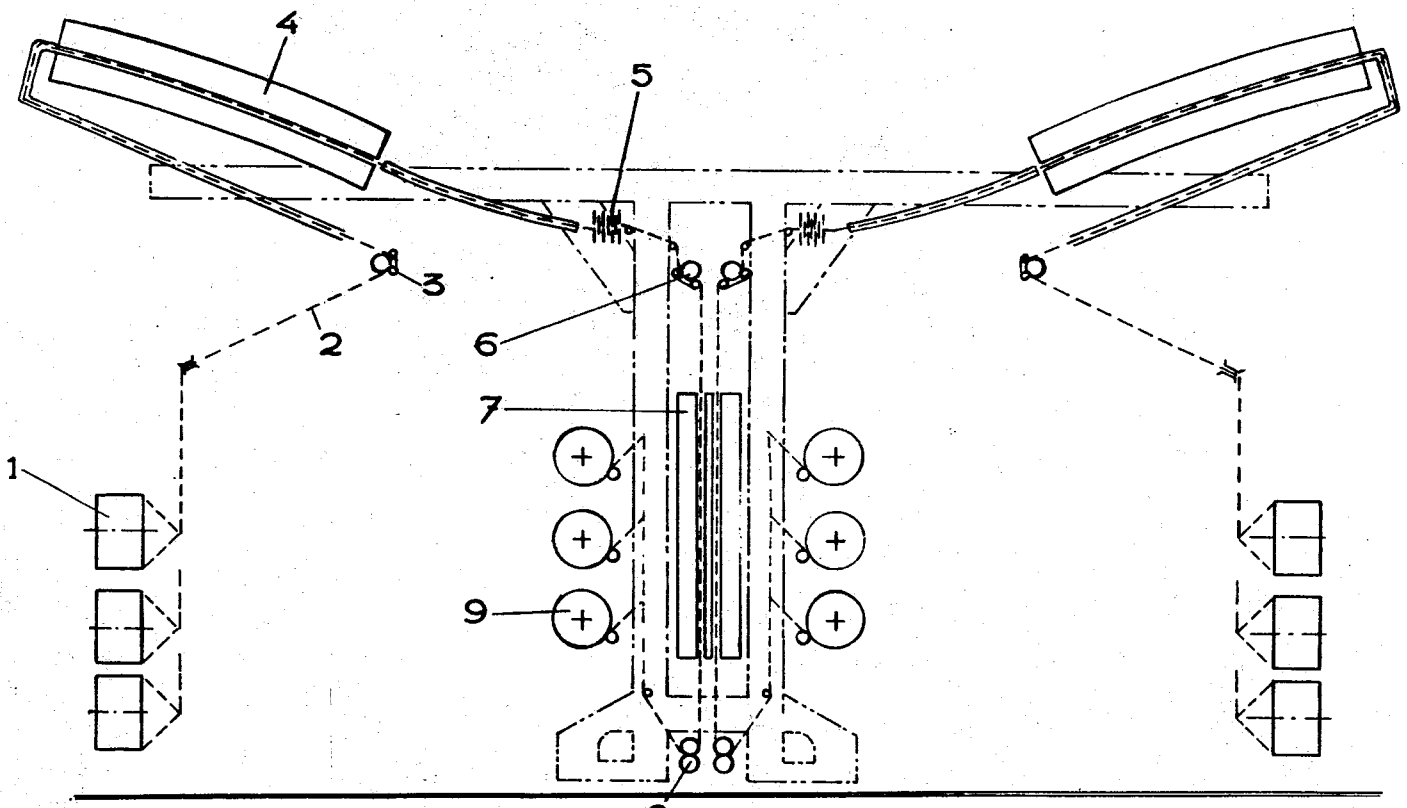
FIG. 1 is a schematic side elevation of a treatment position of one embodiment of machine according to the invention, illustrating, particularly, the path of the yarn at this treatment position.

The false-twist texturising machine shown in the drawings comprises, in a manner which is in itself known, a plurality of treatment positions located side-by-side on the same face of the machine. Each position essentially comprises (see FIG. 1) the following, in sequence: a supply station 1 for the yarn 2, a first feeder 3 of the belt type, capstan type, or some other type, a device 4 for heating the yarn, and a cooling zone, a false-twist texturising spindle 5, a second feeder 6 of a type similar to or different from the feeder 3, a heat resetting device 7, a third feeder 8, which may or may not be similar to feeder 3 or to feeder 6, and a yarn collecting device 9 in the form of a bobbin.

In an embodiment which is not illustrated, the supply device 1 can be located above the heating device 4, which can have certain advantages, particularly if it is desired to take into account the height of an existing building structure.

Figure 2:
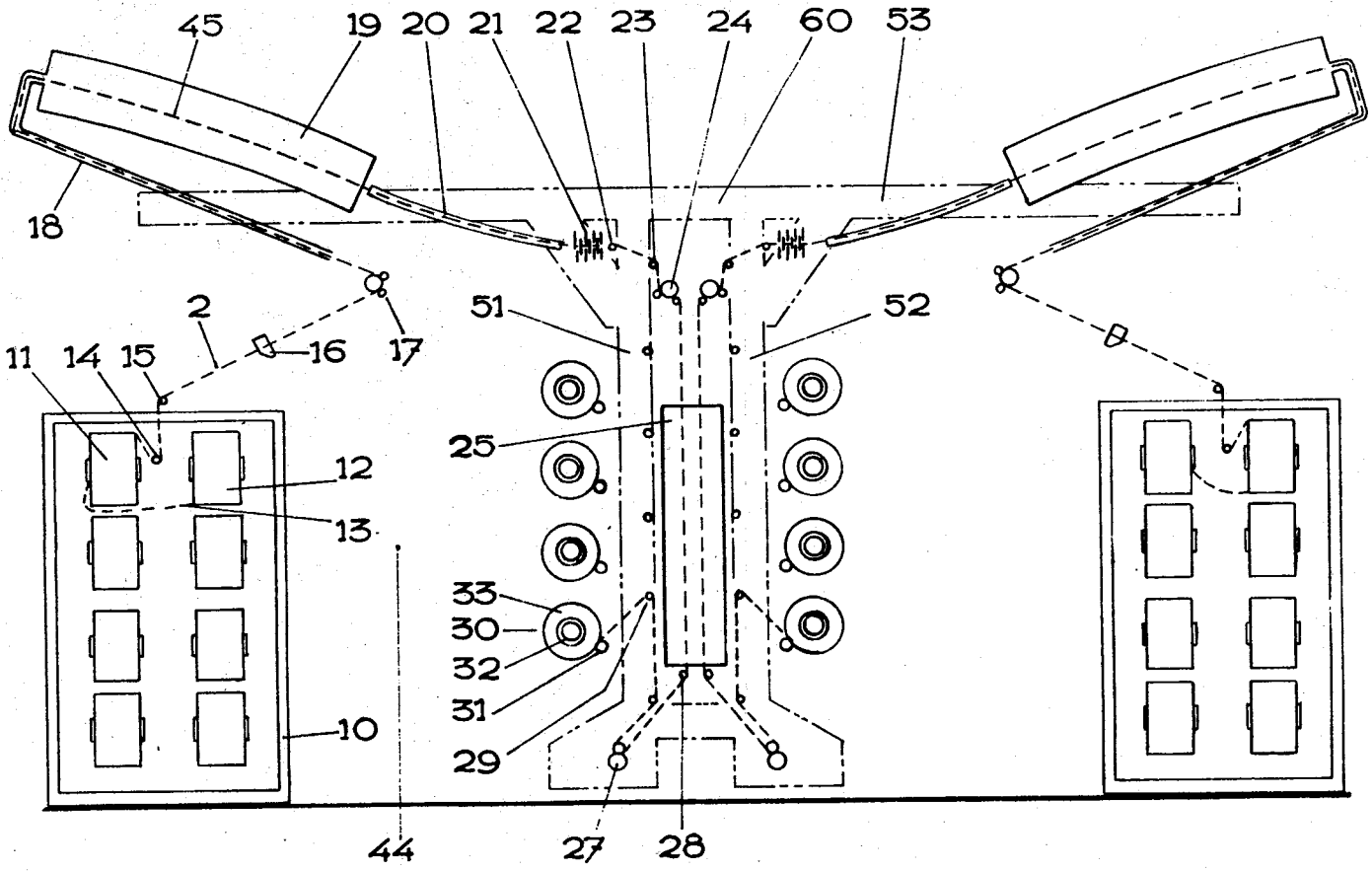
FIG. 2 is a similar more detailed view, in particular showing the central T-shaped framework which is characteristic of the invention.
Figures 5, 6:
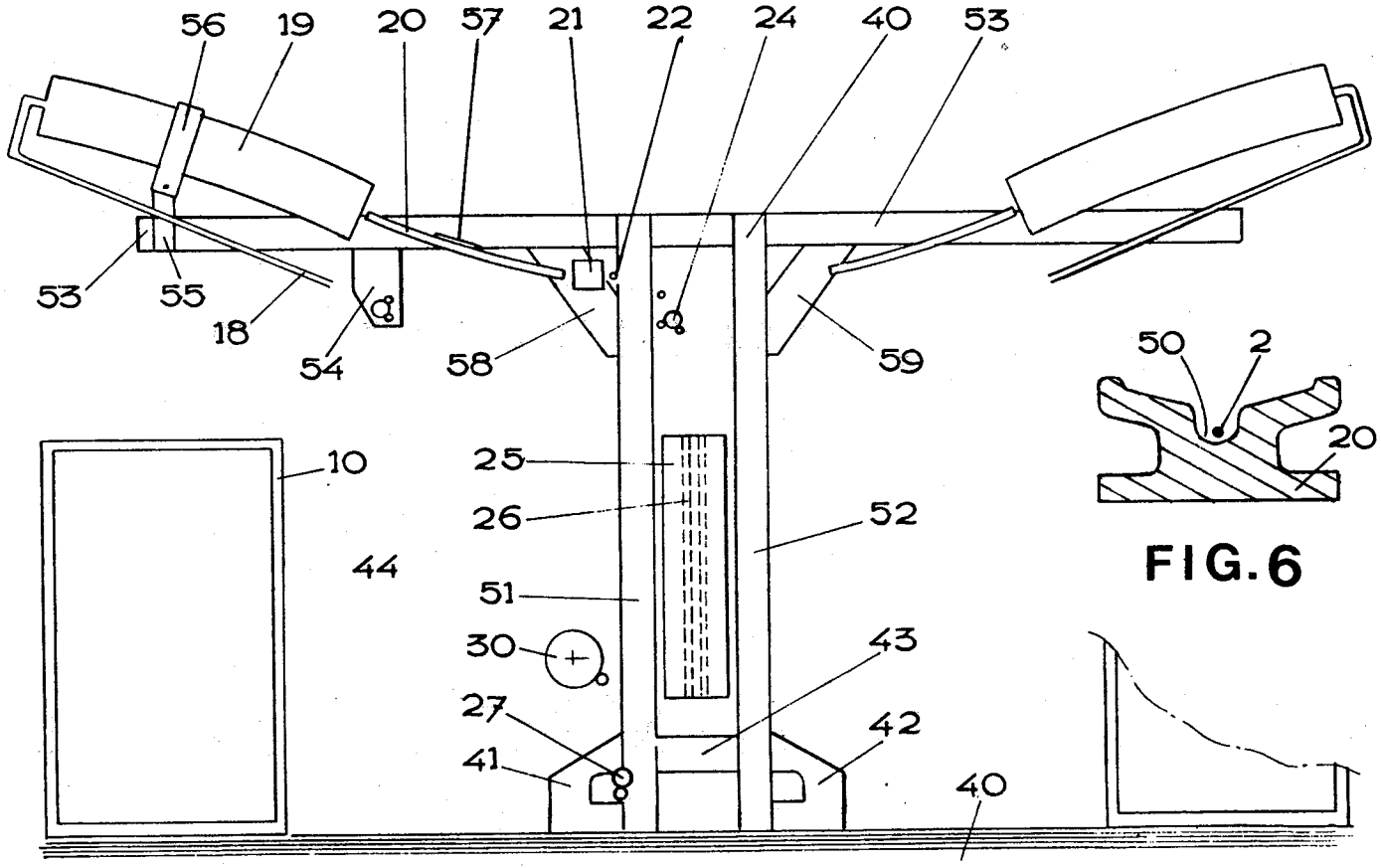
FIG. 5 is a detailed cross-section of this machine.
FIG. 6 is a cross-section of the cooling device.

Referring to the more detailed FIG. 2, the machine is essentially composed of a T-shaped framework 51–60 described in more detail later, a supply creel 10 of the "slide", "rack" or double-pivoting type, which is intended to hold, for each treatment position, two bobbins of yarn, one bobbin 11, being in operation and the other 12, being in reserve, the two bobbins being joined to one another by an attachment tail 13 (in the embodiment illustrated in FIG. 2, the bobbins carry a standard multi-filament synthetic yarn 2), an unwind eyelet 14 made of ceramic, a deflector bar 15, for example made of ceramic, a conventional yarn cutter 16, with its sensor 23 located, for example, at the spindle 21, a first feeder 17, for example of the belt type, located on the horizontal portion 53 of the T-shaped framework, at the entrance of the texturising zone, a J-shaped guide tube 18, intended to guide the yarn 2 to the entrance of the heating device 19, of the type described in French patent application No. 73/37,988, of 19th Oct. 1973, published under No. 2,248,349, with the conventional suction and blowing devices, a substantially horizontal heating device 19, which may or may not be detachable, and which comprises conventional devices which are not shown, such as temperature regulating and control elements and insulating elements, and which may consist either of an open curved plate (see U.S. Pat. No. 2,780,047) or of a rectilinear helical closed tube (see U.S. Pat. No. 3,666,008) or of a heated curved tube (see U.S. Pat. No. 2,891,375) (this device can be heated electrically or by a liquid or vaporised heat transfer fluid, and in the latter case, in order to permit circulation of the heat transfer fluid, as shown in FIG. 2, the heating device is slightly inclined to the horizontal in the median plane, an inclination at an angle of 20° being sufficient), a cooling zone 20, aligned with the path of the yarn at the exit of the heating device 19, which consists of an anodised aluminium shell (see FIG. 6) which has a groove 50 for the passage of the yarn which is to be cooled; this cooling zone 20, located on the T-shaped framework at the top of the zone for the passage of the operator, located between the creel 10 and the central collecting body, can also be provided with a system for the circulation of fluid (water, air and the like), intended to improve the cooling power, a texturising spindle 21, of any type, whether driven by mechanical, pneumatic, magnetic or friction means, and especially of the type utilising friction by means of discs made of ceramic or other materials, this spindle 21 being located horizontally, in practice, so as to facilitate the upstream movement of the twist, and comprising conventional means of disengagement and engagement, a spindle exit eyelet 22, for example made of ceramic, a reciprocating deflector-sensor bar 23, also made of ceramic, a second feeder 24, of a known type, this feeder advantageously being of the belt type, with gradual engagement, as described in U.S. Pat. No. 3,831,830.

a vertical resetting box 25, essentially formed as a rectilinear tube 26, which may or may not be detachable and which is heated electrically or by any other means and comprises means of temperature control and means of fume extraction (via a single central manifold) which are not shown, the path of the yarn, exposed to the atmosphere, between the feeder 24 and the resetting device 25 advantageously being substantial. a third feeder 27 of a known type (of the belt, presser-bar or capstan type), located either directly under the exit of the box 25 (FIG. 1 or 5) or staggered, in a forward direction, relative to the said box (FIG. 2) by means of a deflector bar 28, a ceramic bar or eyelet 29, which also acts as a deflector, and a collecting device 30 of a type which is in itself known, consisting essentially of a drive cylinder 31 mounted on a common multi-position motor shaft intended to cause the rotation, by tangential contact, of a support tube 32 on which a winding 33 forms; this collecting device is also provided with known components for forming the yarn reserve and positioning the bobbin, such as those which are described in French Pat. Nos. 2,109,460, 2,110,563, 2,231,225 and 2,234,774.

The treatment station furthermore comprises known elements, such as:

a sensor 23, advantageously located between the spindle 21 and the second feeder 24, a blowing and fume extraction device in the setting oven 19, for example of the type described in U.S. Pat. No. 3,283,414 and French patent publication No. 2,248,349, already referred to, and devices for controlling the movement of the whole and especially for controlling the feeders 17, 24 and 27, as well as the spindle 21 and the collecting device 30, the speed ratios of these various components being regulated in a particular manner, and controlled, by a set of gearwheels or the like, in a known manner, in accordance with the yarns being treated and the properties desired.

According to one of the essential characteristics of the invention, the machine essentially comprises a T-shaped central framework 60 (FIG. 5), of which the vertical part is formed, for example, of two metal uprights 51 ad 52, between which is placed the resetting box 25, the upright being held together near the bottom by a cross-bar 43. This vertical part carries the spindle 21, the deflector components 22-23, the second feeder 24, the resetting oven 25, the third feeder 27, the deflector bars 28-29 and, in front of each side, the collecting device 30. The horizontal part of the T-shaped central framework 60 is formed of a metal girder 53 to which are fixed the first feeder 17 via a support 54, the setting oven 19 and the guide tube 18, via a hinged strap 55-56, and the cooling plate 20, via a fixing claw 57; this girder 53 is fixed onto the uprights 51-52 by means of two braces 58-59.

Finally, the framework 60 rests on the floor 40 by two feet 41 ad 42 which are intended to provide the mounting for the whole.

As can be seen in FIG. 2, the yarn supply device (creel 10) is located under the end of the horizontal girder 53 of the framework 60 so as to define, with the vertical branch 51-52 of the framework 60, a so-called service zone 44, for the passage of the operator, who thus has easy and convenient access to all the essential parts (feeders, spindle and collector) of the machine and who can conveniently start the yarn. Furthermore, the cooling zone 20 is located just above this service zone 44 and (see FIGS. 2 and 5) is aligned with the path of the yarn at the exit of the setting oven 19.

Figure 4:
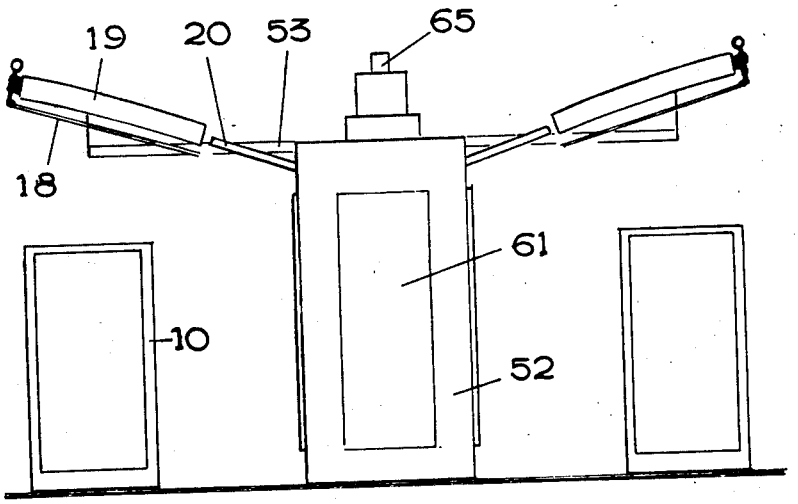
FIG. 4 is a side elevation of the machine showing the space taken up by this machine.

In an embodiment which is not shown, the horizontal branch 53 of the T-shaped framework also carries a drawing zone (so-called sequential drawing and texturising) located upstream from the first feeder 3, 17. In a known manner, this drawing zone consists essentially of a yarn delivery device and a drawing finger which may or may not be heated and around which the yarn forms one or more loops. The ratio of the circumferential speeds of the yarn delivery device and the first feeder 3,17 is regulated in an appropriate and known manner by a set of gearwheels located in the control head 61, (FIG. 4) in accordance with the draw ratio which it is desired to apply to the yarn. In this case, the first feeder also plays the role of a drawing roller. In another embodiment, the drawing and texturising treatment is carried out so-called simultaneously, that is to say in the actual heating zone 19.

Equally it is possible to locate, on the vertical portion 52 of the T-shaped framework, and especially at the height of the collecting device 30, an interlacing nozzle which is not shown and which is intended to impart cohesion to the texturised yarn, and is fed with compressed air from a source which is also not shown.

The bobbin 32 for the winding 33 which is in process of being formed is carried by a hinged arm which forms a stirrup and clamps the bobbin at its two ends; this arrangement is effected in a manner which is known and is not shown, because it is used widely and does not form part of the invention, though being useful for carrying the invention into effect. Equally a bank of suction units of a known type, intended for starting-up the particular station and feeding yarn to waste, is located near this winding 33.

Equally, an optional platform, which may be retractable, and is not shown, can be located in the passage 44 and be used for the operator to walk on.

In practice, the axis of the spindle 21 is horizontal and is substantially aligned with the path of the yarn upstream from the spindle. For certain embodiments, this axis can be inclined.

As already stated, the J-shaped guide tube 18 is of a known type, such as that which is described in French patent publication No. 2,248,349, which has already been cited, and is extensively used by Ateliers Roannais de Construction Textiles in their false-twist texturising machines referred to as FTF 483. This tube 18, for example made of stainless steel, and having an internal diameter of about 8 mm and an external diameter of about 10mm of which the entrance, the two bends and the exit are provided with a ceramic guide to avoid fraying of the yarn, is connected firstly to the heating box 19 containing the heated curved tube 45, which is also made of stainless steel, and, secondly, to a blower which is not shown. Equally, the exit of the heating device 19 is connected to the conventional and known fume extraction device 65, for example of the type having a single central suction manifold fixed onto the oven.

Figure 3:
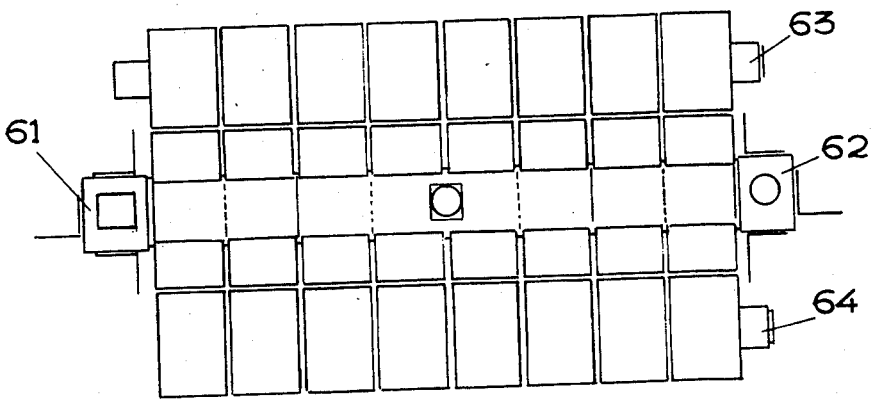
FIG. 3 is a plan view of the machine as a whole.

Finally, the texturising machine also comprises the following, in a manner which is known and is not described in detail because it is used widely (see FIGS. 3 and 4):

a control device (head) 61, feeders 17, 24 and 27, spindles 21 and the collecting device 30, two heads being used advantageously, one called the rear head, 61, and controlled, for example, by a DC motor connected to the feeder 24 and regulated by a set of gears, and the other, called the front head, 62, which controls the formation of the reserve, and controls the cams.

a speed control device (DC motor) which permits slow running, especially in cases of restarting the yarn or restarting the machine, electrical control cabinets 63 and 64 containing the whole of the electrical apparatus; and het regulating devices for the ovens 19 and 25.

The machine according to the invention is particularly suitable for the false-twist texturising of standard yarns, that is to say completely stretched yarns. It is also suitable for a simultaneous or sequential stretching texturising treatment.

This new arrangement offers numerous advantages compared to the arrangements used hitherto, such as, in particular, reduced height and hence ease of access, by the operator, to all the devices for starting the machine, a compact and hence less bulky machine, the possibility of providing a single service passageway for the yarn supply and the yarn collection (the charging and discharging passageway 44), a supply creel which permits the use of large bobbins, a single-block machine, which is therefore less expensive to construct, and, due to all the moving devices being grouped together on the central T-shaped framework, a reduction, or even elimination, of transmissions of movement over a distance, thereby reducing the cost, the noise, and the sources of trouble, scope for having several collecting stages (for example four in FIG. 2), which reduces the space requirement, and ease of starting-up and easy access to the various devices.

This machine is particularly suitable for high speed false-twist texturising, that is to say at speeds of the order of 400 to 600 meters per minute or even higher.

We claim:

1. A yarn texturising machine comprising a plurality of treatment positions, each said position comprising a substantially T-shaped framework, having a vertical portion and a horizontal portion; and, in operational sequence, a yarn supply device, a first yarn feeder, a yarn heating device, a cooling zone for the heated yarn, a false twist spindle, a second yarn feeder and a wind-up device, the false twist spindle, the second feeder and the wind-up device being mounted on the vertical portion of the T-shaped framework and the first feeder, the heating device and the cooling zone being on the horizontal portion, the yarn supply device being mounted at a location below the free end of the horizontal portion, effective to define with the vertical portion, a zone through which the operator can pass and have easy access to the essential parts of the machine.

2. A yarn texturising machine as claimed in claim 1, wherein the yarn supply device is mounted directly below the free end of the horizontal portion.

3. A yarn texturising machine as claimed in claim 1, wherein the cooling zone is located just above the operator passage zone and is aligned with the path of yarn at the exit of the heating device.

4. A yarn texturising machine as claimed in claim 1, wherein the heating device is located substantially horizontally.

5. A yarn texturising machine as claimed in claim 1, wherein the heating device is inclined at about 20° to the horizontal.

6. A yarn texturising machine as claimed in claim 1, and further comprising a third feeder and a resetting device, these being located just upstream from the wind-up device and located on the vertical portion of the T-shaped framework.

7. A yarn texturising machine as claimed in claim 1, wherein the supply device is detachably mounted.

8. A yarn texturising machine as claimed in claim 1, wherein two false twist spindles, two second feeders and two wind-up devices are mounted on the vertical portion of the T-shaped framework and a first feeder, the heating device and the cooling device are mounted on each arm of the horizontal portion, a separate yarn supply device being mounted at a location below the free end of each arm of the horizontal portion, effective to define, with the vertical portion, two zones through which the operator can pass and have easy access to the essential part of the machine, one on each face of the machine.

* * * * *